US005942474A

United States Patent [19]

Tiffany et al.

[11] Patent Number: 5,942,474

[45] Date of Patent: Aug. 24, 1999

[54] TWO-CYCLE ESTER BASED SYNTHETIC LUBRICATING OIL

[75] Inventors: George Mortimer Tiffany, Cranbury, N.J.; Eric Lewis, Oxfordshire, United Kingdom; George C L'Heureux, Scotch Plains, N.J.

[73] Assignee: Exxon Chemical Patents Inc, Linden, N.J.

[21] Appl. No.: 09/068,921

[22] PCT Filed: Nov. 20, 1996

[86] PCT No.: PCT/EP96/05115

§ 371 Date: May 19, 1998

§ 102(e) Date: May 19, 1998

[87] PCT Pub. No.: WO97/19154

PCT Pub. Date: May 29, 1997

[30] Foreign Application Priority Data

Nov. 22, 1995 [GB] United Kingdom ..... 9523916

[51] Int. Cl.[6] ..... C10M 169/04

[52] U.S. Cl. ..... 508/485; 508/499; 508/463; 44/389; 44/388

[58] Field of Search ..... 508/499, 463, 508/485; 44/388, 389

[56] References Cited

U.S. PATENT DOCUMENTS

| | | | |
|---|---|---|---|
| 4,113,642 | 9/1978 | Koch et al. | 508/485 |
| 5,049,291 | 9/1991 | Miyaji et al. | 508/485 |
| 5,221,491 | 6/1993 | Roper et al. | 508/485 |
| 5,330,667 | 7/1994 | Tiffany, III et al. | 508/485 |
| 5,475,171 | 12/1995 | McMahon et al. | 44/300 |
| 5,507,964 | 4/1996 | Bongardt et al. | 44/388 |
| 5,547,597 | 8/1996 | Koganei et al. | 508/409 |
| 5,728,658 | 3/1998 | Duncan | 508/485 |
| 5,744,434 | 4/1998 | Schlosberg et al. | 508/485 |
| 5,830,833 | 11/1998 | Grasshoff et al. | 508/485 |
| 5,866,520 | 2/1999 | Addagaria et al. | 508/485 |

*Primary Examiner*—Jacqueline V. Howard

[57] ABSTRACT

A two-cycle oil which is 10 to 20% of an ester of technical grade pentaerythriol with a mixture of (a) branched C8 and (b) mixed linear C8 and C10 monocarboxylic acids, having a viscosity of 6 to 8 cSt at 100° C., 18 to 30% of an oxo alcohol ester of a dicarboxylic acid having a viscosity of 3 to 10 cSt at 100° C., 30 to 40% of a polybutene having an Mn of 300–1500, 15 to 35% of a normally liquid solvent having a boiling point up to 300° C., 0 to 5% of other lubricating oil additives.

13 Claims, No Drawings

TWO-CYCLE ESTER BASED SYNTHETIC LUBRICATING OIL

This application is a 371 of PCT/EP96/05115 Nov. 20, 1996.

This invention relates to a lubricant composition useful as a two-cycle oil. More particularly the invention relates to two-cycle synthetic oil which complies with certain test standards for land equipment, gasoline fuelled, two-cycle engines, such as motorcycle engines, moped engines, snowmobile engines, lawn mower engines and the like. Two-stroke-cycle gasoline engines now range from small, less than 50 cc engines, to higher performance engines of 200 to 500 cc. The development of such high performance engines has created the need for new two-cycle oil standards and test procedures. The present composition exhibits improved detergency and reduced exhaust port blocking characteristics.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

U.S. Pat. No. 4,994,196 (1991) discloses two-cycle engine oils comprising alpha olefin dicarboxylic ester copolymers in combination with esters of pentaerythritol and calcium phenate.

U.S. Pat. No. 5,378,249 (1995) discloses biodegradable two-cycle engine oil compositions which comprise 20–80% of a heavy ester having a viscosity of at least 7 cSt at 100° in combination with 10–85 weight percent of a light ester oil having a viscosity less than 6.0 cSt at 100°.

EP-A-0 572 273 discloses lubricating oil compositions for two-stroke engines comprising 30 to 70% of a polyol ester, 30 to 70% of a diester and 1 to 5% of a polybutene of molecular weight 500 to 2500 and/or 1 to 5% of a polymethylmethacrylate of molecular weight 5,000 to 40,000 and 5 to 25% of a dispersant. The compositions have good bio-degradability.

EP-A-0 640 680 discloses two-stroke oil compositions comprising polybutenes which are very low in, or substantially free of n-butenes in order to achieve low smoke emission. Synthetic esters may be present but specific esters are not disclosed.

The present invention is based on the discovery that the use of a blend of ester basestock oils in two-cycle oil formulations provides lubricants which exhibit improvements, as measured by two-cycle engine tests, most notably in exhaust port blocking reduction and detergency.

Accordingly, there has been discovered a two-cycle lubricating oil composition comprising:

a) 10–20% by weight of a first synthetic ester basestock oil being an ester of pentaerythritol (technical grade) with a mixture of $C_8$ branched and $C_8$–$C_{10}$ linear morocarboxylic acids, the oil having a viscosity of 6 to 8 $mm^2/s$ (cSt) at 100° C.;

b) 18–30% by weight of a second synthetic ester base stock oil being an oxo alcohol ester of a dicarboxylic acid, the oil having a viscosity of 3 to 10 $mm^2/s$ (cst) at 100° C.;

c) 30 to 40% by weight of a polybutene polymer being a polybutene, polyisobutylene or a mixture of polybutenes and polyisobutylenes having a number average molecular weight of 300 to 1500;

d) 15 to 35% by weight of a normally liquid solvent having a boiling point of up to 300° C.; and a flash point of 60° to 120° C., and e) 0–5% by weight of lubricating oil additives other than a polybutene.

This invention also comprises the use of the foregoing oil in a two-cycle engine.

The first synthetic ester base oil is known in the art and is the ester of technical grade pentaerythritol with a mixture of (a) $C_8$ branched monocarboxylic acids and (b) linear mixed $C_8$ and $C_{10}$ monocarboxylic acids. Technical grade pentaerythritol contains 86–90% by weight monopentaerythritol, 7–12% dipentaerythritol and 1–2% tripentaerythritol. The acids comprise 45–55 mol % of branched $C_8$ acids, preferably 45 mol %, and 55–45 mol % of a mixture of linear $C_8$ and $C_{10}$ acids, preferably 55 mol %. This acid mixture of linear octanoic and decanoic acids comprises 48–58 mol % of $C_8$ and 36–42 mol % of $C_{10}$, and very minor amounts of $nC_6$ and $nC_{12}$ acids, e.g. 3–5 mol % $nC_6$ and 0.5–1 mol % $nC_{12}$ acid are typically present. The preferred ester oil has a viscosity of 6.8 $mm^2/s$ (cSt) at 100° C. and the preferred amount is 15% by weight.

The second synthetic ester component is a basestock oil comprising an oxo alcohol ester of a polycarboxylic acid. Suitable oxo alcohols comprise those having 8 to 20 carbon atoms, preferably those having 10 to 15 carbon atoms, particularly oxo tridecyl alcohol. Such oxo alcohols are prepared by the process well known in the art which involves the catalytic reaction of olefins with carbon monoxide and hydrogen at elevated temperatures of 300 to 400° F. and pressures of 172 to 276 bar (2500 to 4000 psig) to form particularly in the presence of cobalt catalyst aldehydes having more than 1 carbon atom than the olefin feedstock, the aldehyde then being hydrogenated to the corresponding alcohol. Illustrative Examples of suitable dibasic acids which may be employed to synthesize the oxo diester fluid used in the present invention are oxalic acid, malonic acid, succinic acid, glutaric acid, adipic acid, pomelic acid, suberic acid, azelaic acid and the like, generally this being 2 to 10 carbon atoms. Particularly preferred are adipic acid and alkyl adipic acids such as methyladipic acid and diethyladipic acid. Such oxo esters synthetic base oils will have a viscosity in the range of 3 to 10 $mm^2/s$ (cSt) at 100° for use in the present invention and they are preferably used in an amount of about 19 to 25%. Particularly preferred is a material sold by Exxon Chemical Company as "Vistone A-30", an oxo tridecyl alcohol adipate having a viscosity of 5.3 $mm^2/s$ (cSt) at 100° C. used in an amount of 20.48%.

The polybutene polymer used in this invention is typically a mixture of polybutenes, a mixture of poly-n-butenes and polyisobutylene which normally results from the polymerization of $C_4$ olefins and generally will have a number average molecular weight of 300 to 1500 with a polyisobutylene or polybutene having a number average molecular weight of 400 to 1300 being particularly preferred, most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer".

A preferred polybutene polymer is a mixture of polybutenes and polyisobutylene prepared from a $C_4$ olefin refinery stream containing 6 wt. % to 50 wt. % isobutylene with the balance a mixture of butene (cis-and trans-) isobutylene and less than 1 wt %. butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis. Preferably, the oils of this invention contain 35 wt. % polybutene.

The solvents useful in the present invention may generally be characterized as being normally liquid petroleum or synthetic hydrocarbon solvents having a boiling point not higher than 300° C. at atmosphere pressure. The preferred amount is 25% by weight. Such a solvent must also have a flash point in the range of about 60–120° C. such that the flash point of the two-cycle oil of this invention is greater than 70° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the two-cycle oil. Preferred is a naphthenic type hydrocarbon solvent having a boiling point range of about 91.1° C.–113.9° C. (196°–237° F.) sold as "Exxsol D80" by Exxon Chemical Company.

The invention further comprises the presence of up to 5% by weight of one or more special purpose conventional lubricating oil additives, and these may be any additive normally included in lubricating oils for a particular purpose.

Additional conventional additives for lubricating oils which may be present in the composition of this invention include viscosity modifiers, corrosion inhibitors, oxidation inhibitors, friction modifiers, dispersants, antifoaming agents, antiwear agents, pour point depressants, detergents, rust inhibitors and the like.

Typical oil soluble viscosity modifying polymers will generally have weight average molecular weights of from 10,000 to 1,000,000 as determined by gel permeation chromatography.

Corrosion inhibitors are illustrated by phosphosulfurized hydrocarbons and the products obtained by reacting a phosphosulfurized hydrocarbon with an alkaline earth metal oxide or hydroxide. "Cobratech 356", which is benzotrizole in propylene glycol, is preferred for use in this invention in an amount of 0.03 wt. %.

Oxidation inhibitors are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phospho sulfurized hydrocarbons. Also included are oil soluble antioxidant copper compounds such as copper salts of $C_{10}$ to $C_{18}$ oil soluble fatty acids.

Friction modifiers include fatty acid esters and amides, glycerol esters of dimerized fatty acids and succinate esters or metal salts thereof.

Dispersants are well known in the lubricating oil field and include high molecular weight alkyl succinimides being the reaction products of oil soluble polyisobutylene succinic anhydride with ethylene amines such as tetraethylene pentamine and borated salts thereof. Preferred for use in this invention is 2.41% of a dispersant comprising a borated Mn 950 polyisobutenyl succinimide.

Pour point depressants also known as lube oil flow improvers can lower the temperature at which the fluid will flow and typical of these additives are $C_8$–$C_{18}$ dialkyl fumarate vinyl acetate copolymers, polymethacrylates and wax naphthalene.

Foam control can also be provided by an anti-foamant of the polysiloxane type such as silicone oil and polydimethyl siloxane.

Anti-wear agents reduce wear of metal parts and representative materials are zinc dialkyldithiophosphate and zinc diaryl diphosphate.

Detergents and metal rust inhibitors include the metal salts of sulfonic acids, alkylphenols, sulfurized alkylphenols, alkyl salicylates, naphthenates and other oil soluble mono and dicarboxylic acid. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Preferred for use in this invention is 1.5% by weight nonylphenol sulfide.

Also suitable as detergents are neutral and basic salts of phenols, generally known as phenates, wherein the phenol is generally an alkyl substituted phenolic group, where the substituent is an aliphatic hydrocarbon group having 4 to 400 carbon atoms. Preferred for use in the invention is 0.58% by weight calcium phenate.

Also suitable are oil soluble copper carboxylates which may be present in amounts of 0.2 to 2% by weight and are used as antioxidants or to improve engine performance, examples being copper oleate or copper naphthenate in amounts of 0.5 to 1.5% by weight.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline is defined by ASTM specification D-439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc. Particularly preferred is gasoline, that is, a mixture of hydrocarbons having an ASTM boiling point of 60° C. at the 10% distillation point to 205° C. at the 90% distillation point.

The lubricants of this invention are used in admixture with fuels in amounts of 20 to 250 parts by weight of fuel per 1 part by weight of lubricating oil, more typically 30–100 parts by weight of fuel per 1 part by weight of oil. Such admixtures and their use in two-cycle engines are further embodiments of this invention.

The invention is further illustrated by the following examples, which are not to be considered as limitative of its scope. Example 2 is for comparison and is not part of this invention. All percentages are by weight.

EXAMPLE 1

An oil of the invention was prepared from the following: (Trademarked components (a), (b), (c) and (h) are identified in the specification), and "TPE ester" is the preferred ester of technical grade pentaerythritol with a mixture of 45 mol % linear $C_8$ acid and 55 mol % of a mixture of n-octanoic and n-decanoic acid having a viscosity of 6.8 $mm^2/s$ (cSt) at 100° C. as disclosed in the specification:

| Component | Oil 1 |
|---|---|
| (a) TPE Ester | 15.00% |
| (b) "Vistone A-30" | 20.48% |
| (c) "Exxsol D-80" | 25.00% |
| (d) Polyisobutylene Mn 950 | 35.00% |
| (e) Borated Mn 950 polyisobutenyl succinimide dispersant | 2.41% |
| (f) Calcium Phenate | 0.58% |
| (g) Nonylphenol sulfide | 1.50% |
| (h) "Cobratech 35G" | 0.03% |
| | 100% |

This oil was evaluated in accordance with the JASO M345 test procedures JASO M340, M341, M342 and M343. This is an engine test established by society of Automotive Engineers of Japan (JSAE) for two-cycle gasoline engine oils. As of Jul. 1, 1994, oils used in two-cycle engines are being labeled in accordance with the JASO-M345 standards as announced by the Japan Automobile Standards Organization (JASO). JASO published the JASO M345 standards in April, 1994. "EGD Detergency" is a reference to a further modification of the normal JASO M341 detergency test (1 hour) procedure in which the test is run for 3 hours. This is a more stringent standard expected to be adopted py ISO (the International Organization for Standardization) as published by Committee Draft of Jan. 5, 1995 of the Technical Committee 28. "FC" is the highest performance standard for the JASO M345 standards.

EXAMPLE 2

(Comparative Example)

Oil 2 was the same as Oil 1 of the invention except that "Ketjenlube 135" a synthetic ester being a butanol ester of an alpha-olefin maleic acid copolymer used which had a Mn of 1800 and a viscosity of 35 $mm^2/s$ (cSt) at 100° C. in place of the TPE Ester.

The engine test results for Oils 1 and 2 are in the Table below:

Engine Test Results - JASO M345 & ISO-EGD

| | JASO M345 | | | |
|---|---|---|---|---|
| Oil | 1 | 2 | Standard -FC Minimum | ISO-EGD Minimum |
| EGD Detergency | 145 | 122 | — | 125 |
| JASO Detergency M341 | 123 | 111 | 95 | — |
| JASO Lubricity M340 | 101 | 112 | 95 | 95 |
| JASO Torgue M340 | 99 | 99 | 98 | 98 |
| JASO Blocking M343 | 153 | 93 | 90 | 90 |
| JASO Smoke M342 | 125 | 157 | 85 | 85 |

What is claimed is:

1. A two-cycle oil composition which comprises:

(a) 10–20% of a first synthetic ester base stock oil being an ester of technical grade pentaerythritol with a mixture of (a) branched $C_8$ and (b) mixed linear $C_8$ and $C_{10}$ monocarboxylic acids, the oil having a viscosity of 6 to 8 cSt at 100° C., (b) 18–30% of a second synthetic ester base stock oil being an oxo alcohol ester of a dicarboxylic acid, the oil having a viscosity of 3 to 10 cSt at 100° C., (c) 30 to 40% of a polybutene having an Mn of 300–1500, (d) 15 to 35% of a normally liquid solvent having a boiling point up to 300° C. and having a flash point of 60° to 120° C. and (e) 0 to 5% of other lubricating oil additives.

2. The composition of claim 1 wherein said (a) amount is 15%, said (b) amount is 19–25%, said (c) amount is 35% and said (d) amount is 25%.

3. The composition of claims 1 or 2 wherein (b) is oxo tridecyl adipate having a viscosity of 5.3 $mm^2/s$ (cSt) at 100° C.

4. The composition of claims 1 or 2 wherein (c) polybutene has an Mn of 950.

5. The composition of claims 1 or 2 wherein (d) is a naphthenic solvent having a boiling point range of 91.1° C.–113.9° C.

6. A fuel lubricant mixture for two-cycle engines which exhibits improved detergency and reduced exhaust port blocking upon combustion which comprises 20 to 250 parts by weight, fuel per 1 part by weight of the oil of claims 1 or 2.

7. The mixture of claim 6 wherein the range is 30–100 parts of fuel per part of oil.

8. A method for improving detergency and reducing exhaust port blocking upon combustion of a two-cycle engine fuel, the method comprising adding to the two-cycle engine fuel an oil composition of claim 1.

9. The method of claim 8 wherein 1 part by weight of the oil composition is added to the two-cycle engine fuel per 20 to 250 parts by weight of the two-cycle engine fuel.

10. The method of claim 8 wherein 1 part by weight of the oil composition is added to the two-cycle engine fuel.

11. The method of claim 8 wherein (b) is oxo tridecyl adipate having a viscosity of about 5.3 cSt at 100° C.

12. The method of claim 8 wherein (c) polybutene has an Mn of 950.

13. The method of claim 8 wherein (d) is a naphthenic solvent having a boiling point range of 91.1° C.–113.9° C.

* * * * *